US008272498B2

(12) United States Patent
Ponti

(10) Patent No.: US 8,272,498 B2
(45) Date of Patent: Sep. 25, 2012

(54) CONVEYOR FOR TRANSPORTING AND OVERTURNING FLAT OBJECTS, SUCH AS SHEAVES OF PAPER OR PRINTED MATERIALS

(75) Inventor: Francesco Ponti, Cerbara-Citta'di Castello (IT)

(73) Assignee: C.M.C S.r.l., Cerbara-citta di Castello (Perugia) (IT)

( * ) Notice: Subject to any disclaimer, the term of this patent is extended or adjusted under 35 U.S.C. 154(b) by 227 days.

(21) Appl. No.: 12/671,063

(22) PCT Filed: Aug. 1, 2008

(86) PCT No.: PCT/IB2008/002005

§ 371 (c)(1), (2), (4) Date: Jan. 28, 2010

(87) PCT Pub. No.: WO2009/019560

PCT Pub. Date: Feb. 12, 2009

(65) Prior Publication Data

US 2010/0213029 A1 Aug. 26, 2010

(30) Foreign Application Priority Data

Aug. 6, 2007 (IT) ..... BO2007A0568

(51) Int. Cl.
*B65G 47/24* (2006.01)

(52) U.S. Cl. ..... 198/405; 198/407; 271/186

(58) Field of Classification Search ..... 198/402, 198/403, 405, 406, 407; 270/58.06; 271/186
See application file for complete search history.

(56) References Cited

U.S. PATENT DOCUMENTS 3,838,771 A 10/1974 Whiteford
4,226,324 A * 10/1980 Stocker ..... 198/405
4,747,817 A * 5/1988 Newsome ..... 493/438
4,850,582 A * 7/1989 Newsome ..... 271/185
(Continued)

FOREIGN PATENT DOCUMENTS

EP 0182713 A 5/1986
(Continued)

OTHER PUBLICATIONS

International Search Report, Jan. 2009.

*Primary Examiner* — Douglas Hess
(74) *Attorney, Agent, or Firm* — William J. Sapone; Coleman Sudol Sapone P.C.

(57) ABSTRACT

In a conveyor for transporting and overturning flat objects, such as sheaves of paper or printed materials, a first ring-bound belt (10) is positioned above a second belt (20), which is also ring-wound, in such a way that an active branch (13) of the first belt (10) faces and is in contact with a corresponding active branch (23) of the second belt (20). The first belt (10) and the second belt (20) are subject to an axial torsion of 180°, thus exchanging their positions in such a way that the sheaves (2) which are inserted into an input section (30) exit overturned from an output section (40). Further, the first belt (10) is longitudinally staggered in relation to the second belt (20), in such a way that an upstream roller (11) of the first belt (10) is staggered in relation to a corresponding upstream roller (21) of the second belt (20), and that the downstream roller (22) of the second belt (20) is staggered in relation to a downstream roller (12) of the first belt (10).

18 Claims, 4 Drawing Sheets

U.S. PATENT DOCUMENTS

| | | | | |
|---|---|---|---|---|
| 4,860,880 | A * | 8/1989 | Hinchcliffe et al. | 198/405 |
| 5,411,250 | A * | 5/1995 | Belec et al. | 271/185 |
| 5,540,318 | A * | 7/1996 | Hulse | 198/405 |
| 5,988,352 | A * | 11/1999 | Ballestrazzi et al. | 198/405 |
| 6,409,008 | B1 * | 6/2002 | Newsome | 198/403 |
| 6,598,760 | B1 * | 7/2003 | Wilson | 221/131 |
| 6,626,103 | B2 * | 9/2003 | Neumann | 101/230 |
| 7,032,737 | B2 * | 4/2006 | Egger | 198/405 |
| 7,036,654 | B2 * | 5/2006 | Frost | 198/406 |
| 7,841,594 | B2 * | 11/2010 | Janatka et al. | 271/184 |
| 2002/0069774 | A1 | 6/2002 | Neumann et al. | |

FOREIGN PATENT DOCUMENTS

| | | | |
|---|---|---|---|
| GB | 1567603 | A | 5/1980 |

* cited by examiner

CONVEYOR FOR TRANSPORTING AND OVERTURNING FLAT OBJECTS, SUCH AS SHEAVES OF PAPER OR PRINTED MATERIALS

TECHNICAL FIELD

The invention concerns a conveyor device which is generally used in conjunction with envelope-filling machines, for transferring piled-up sheaves of paper or printed materials in general, from a line along which the sheaf has been prepared, to a station for inserting the sheaf into an envelope.

In particular, this invention concerns a conveyor which can overturn the sheaf and which exhibits some constructionally simplified components.

BACKGROUND ART

It is known that in envelope-filling machines, sheaves of sheets of paper or in general of printed materials are prepared along a conveyor line, on which devices are arranged to distribute the sheets or printed materials which have to be piled one on top of the other to constitute the sheaves.

Thus formed, the sheaves must then be transferred to a station of the machine, where they are inserted into respective envelopes which are suitably positioned and held open to facilitate the operation.

At times, when using window envelopes for example, when the sheaf must also include a sheet bearing an address, the sheet bearing the address is situated on the opposite side relative to the side of the envelope containing the window. This may be caused by a particular order of deposition of the sheets along the preparation line, which order may in such cases be unavoidable.

For example, the first distributed sheet may bear a bar code indicating how many and which sheets must subsequently placed one on top of the other. The code must be readable by a bar code reader, and must therefore face downwards so as not to be covered by subsequent sheets.

For constructional and functional reasons, known to persons skilled in the art, on a same machine the envelopes must always be supplied to the envelope-filling station with the same orientation, so that in the case mentioned, it becomes necessary to overturn the sheaf in order for the sheet bearing the address, which also bears the bar code, to be situated on the window side of the envelope.

To this end, a linking conveyor is usually provided between the preparation line and the envelope-filling station. Along the conveyor there is an overturning device, which, after receiving the sheaf, rotates it by 180°, then restoring the sheaf to the advancement direction towards the envelope-filling station.

The sheaf-overturning device can operate in two different ways. In the first, the sheaf is halted at a section rotating around a transversal axis to the advancement direction, and which generally coincides with one end of the sheaf. In the second, the sheaf is halted at a section which rotates around an axis which is parallel to the advancement direction, generally arranged along the centre line thereof.

The constructional and operational complexity of a device such as the one described above is self-evident.

Equally evident are the drawbacks associated with this type of conveyor, where transfer to the overturning device increases the risk of jamming, in addition evidently to slowing down operations.

Linking conveyors are known which are specially designed for transferring sheaves of paper or other printed materials from one operating station of a same machine to another, or from one machine to another. These devices are constituted by two belt conveyor devices, arranged one above the other. A problem with these known conveyor devices is constituted by the sheaf input and output sections of the linking conveyor. In these sections, in fact, the position of the rollers of the lower conveyor coincides with that of the rollers of the upper conveyor, along shared tangential lines.

As the device has to handle sheaves having different thicknesses, in order to avoid laborious adjustment operations and allow the device to operate without having to stop whenever the thickness varies, the bearing rollers of the upper conveyor are each mounted on a vertically mobile element, upon which springs act, pushing the element towards the corresponding lower roller.

In this way, the roller is positioned for the minimum predetermined thickness for the sheaves, and when the sheaf increases in thickness, the roller is elastically displaced, thus allowing passage of the thicker sheaf. Subsequently, the springs reposition the roller in the selected position.

Although simple, this solution nevertheless impacts negatively on construction costs, in addition to requiring greater maintenance on organs which need to be able to move constantly without hindrance so as to enable the sheaves to pass with ease.

SUMMARY OF THE INVENTION

The aim of the present invention is to modify the conveyor linking to the envelope-filling station, primarily in order to make the linking conveyor both constructionally and functionally simpler.

Structural simplification of the conveyor must improve and speed up operation of the conveyor, eliminating halts and downtimes.

In the above-mentioned ambit of simplification, a further aim of the invention is to improve the structure of the conveyor in such a way as to make the handling of sheaves of different thicknesses easier, while eliminating mobile support elements for the rollers.

A still further aim of this invention, in accordance with the aims mentioned above, is to have a positive impact on machine construction costs, reducing the need for maintenance and adjustment of operating organs as far as possible.

These and other aims of the invention are achieved by means of a conveyor for conveying and overturning flat objects, such as piled-up sheaves of paper or printed materials, constituted by a first ring-wound belt mounted on rollers, respectively an upstream roller of the first belt and a downstream roller of the first belt, a second ring-wound belt mounted on rollers, respectively an upstream roller of the second belt and a downstream roller of the second belt, with an active branch of the first belt facing and in contact with a corresponding active branch of the second belt, thus constituting an input section between the upstream roller of the first belt and the upstream roller of the second belt, and an output section between the downstream roller of the first belt and the downstream roller of the second belt, characterised in that the first belt and the second belt are subjected to an axial torsion of 180°, in order to exchange the position of the first belt and the second belt; the first belt is longitudinally staggered in relation to the second belt, so that the upstream roller of the first belt is staggered in relation to the corresponding upstream roller of the second belt, and that the downstream roller of the second belt is staggered in relation to the downstream roller of the first belt.

Variants and other embodiments of the invention are described in the dependent claims.

BRIEF DESCRIPTION OF THE DRAWINGS

Characteristics and aims of the invention which have not become clear from the above description will emerge from the following description of a preferred embodiment of the invention, with the aid of the appended figures of the drawings, in which.

BEST MODE FOR CARRYING OUT THE INVENTION

Figure 1:
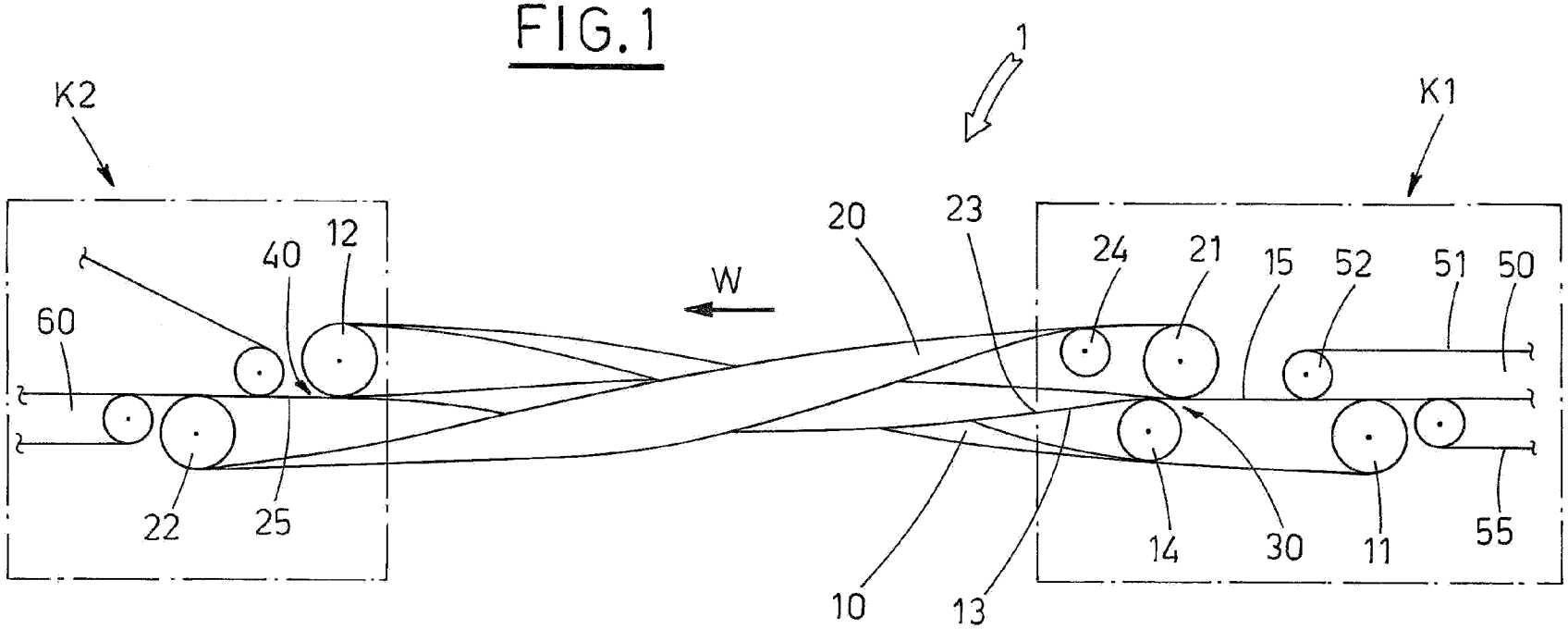
FIG. 1 is a schematic lateral view of the essential components of the conveyor device of the invention.

In the above figures, reference number 1 indicates the conveyor device which is the object of this invention, and which constitutes the link between the preparation line 50 (of which only the end part is shown in FIG. 1) of the sheaves 2 of sheets of paper or printed material (shown by way of example using dotted lines in FIG. 4 and for the sake of simplicity referred-to as "sheaves" hereinafter), and the envelope-filling station, of which only the access section 60 is shown.

The conveyor of the invention, in addition to its linking function as described above, also has the task of overturning the sheaves 2. The conveyor 1 is constituted by two belts, 10, 20 each having an active branch facing the active branch of the other belt and counterposed to it, as will be better described herein below.

A first belt 10 is ring-wound and fitted on parallel rollers, respectively an upstream roller 11 and a downstream roller 12. The rollers 11, 12 are rotatingly fitted on respective axes that are horizontal and transversal in relation to the extension direction of the belts and in particular in relation to the advancement direction W of the sheaves 2, as can clearly be seen in FIGS. 1 and 4.

A second belt 20 is also ring-wound and fitted on rollers, respectively an upstream roller 21 and a downstream roller 22, which are parallel to one another and to the rollers 11 and 12 of the first belt 10. The second rollers 21 and 22 are also rotatingly fitted on respective axes, which are horizontal and transversal in relation to the extension of the belts and in particular in relation to the advancement direction W of the sheaves 2.

The two belts 10, 20 are arranged in such a way that a first active branch 13 of the first belt 10 faces and is in contact with a corresponding second active branch 23 of the second belt 20.

The belts 10 and 20 rotate in opposite directions, in such a way that the two active branches 13 and 23 facing each other move synchronously in the same advancement direction W.

Thus, the upstream roller 11 of the first belt 10 and the upstream roller 21 of the second belt 20 together constitute an input section 30 for the sheaves 2, which are conveyed along the end part of the preparation line 50.

In the same way, the downstream roller 12 of the first belt 10 and the downstream roller 22 of the second belt 20 constitute between them an output section 40 for the by-now overturned sheaves 2, which are delivered to the access section 60 of the envelope-filling station (not shown).

A first peculiarity of the conveyor 1 of the invention consists in the fact that the first belt 10 and the second belt 20 are subject to an axial torsion of 180°, such that their relative positions are exchanged.

Thus the active branch 13 of the first belt 10, which is situated in the lower position at the input section 30, finds itself in the upper position at the output section 40; and the active branch 23 of the second belt 20, which is situated in the upper position at the input section 30, finds itself in the lower position at the output section 40.

In this way, the sheaves 2 which enter the input section 30 exit overturned at the output section 40.

A second important peculiarity of the conveyor 1 of the invention, consists in the fact that the first belt 10 is longitudinally staggered in a downstream direction in relation to the second belt 20, so the upstream roller 11 of the first belt 10 is staggered in relation to the corresponding upstream roller 21 of the second belt 20, and that the downstream roller 22 of the second belt 20 is offset relative to the downstream roller 12 of the first belt 10.

As a result of this staggering of the first belt 10 and the second belt 20, an initial portion 15 of the first belt 10 projects relative to the second belt 20, towards the end portion of the preparation line 50 of the sheaves 2.

In the same way, consequent to the staggering between the first belt 10 and the second belt 20, an end portion 25 of the second belt 20 projects relative to the first belt 10 towards the access section 50 of the envelope-filling station.

In practice, the two belts are longitudinally staggered, so that a part of one belt is free at the input section, while a part of the other belt is free at the output section.

The aim of this staggered arrangement is to prevent the upstream rollers 11 and 21, and the downstream rollers 12 and 22, of the first belt and of the second belt, from finding themselves on the same vertical plane, with a tangential transversal line between them. This configuration, in fact, would require one of the rollers, usually the upper one, to be fitted on a vertically mobile element which is subject to the elastic pressure of a spring, as is generally the case in the prior art. This allows sheaves of sheets to pass even if their thickness differs from the nominal thickness, which corresponds to the distance between the rollers. A thicker sheaf moves the upper roller, in contrast with the elastic action of the spring, and inserts itself between the two belts.

Instead, in the configuration provided according to the invention, it is not necessary for the mobile element to support one of the rollers, since the belts themselves compensate for the greater or lesser thickness of the sheaves. Each belt can in fact distance itself from the roller of the opposite belt, since it does not have a roller of its own which rigidly contrasts this action in that position.

This action, shown in detail in FIG. 3, will be made clearer below, when operation of the conveyor is described.

A support roller 14 is provided for the first belt and is arranged downstream of the upstream roller 21 of the second belt 20. The function of this support roller 14 is to keep the initial portion 15 of the first belt 10 level and horizontal down to a zone beyond the upstream roller 21 of the second belt, thus ensuring correct entry of the sheaves between the roller 21 and the first belt 10.

The inactive branch of the second belt 20 is instead supported by a support roller 24 downstream of the relative upstream roller 21 of the second belt 20, which support roller 24 supports the second belt 20. The inactive branch of the second belt is supported in order to prevent a curving of the belt, consequent on a twisting of the belts, which would hinder the passage of the sheaves and damaging the corners thereof.

To facilitate conveying the sheaves without giving rise to unwanted creases caused by the acceleration of rotation during the overturning process, two helical guides are provided (which are not shown so as not to hamper vision of the device) which are provided for example by metal bars shaped in such a way as to follow the conformation of the two belts 10, 20.

Figures 2, 3:
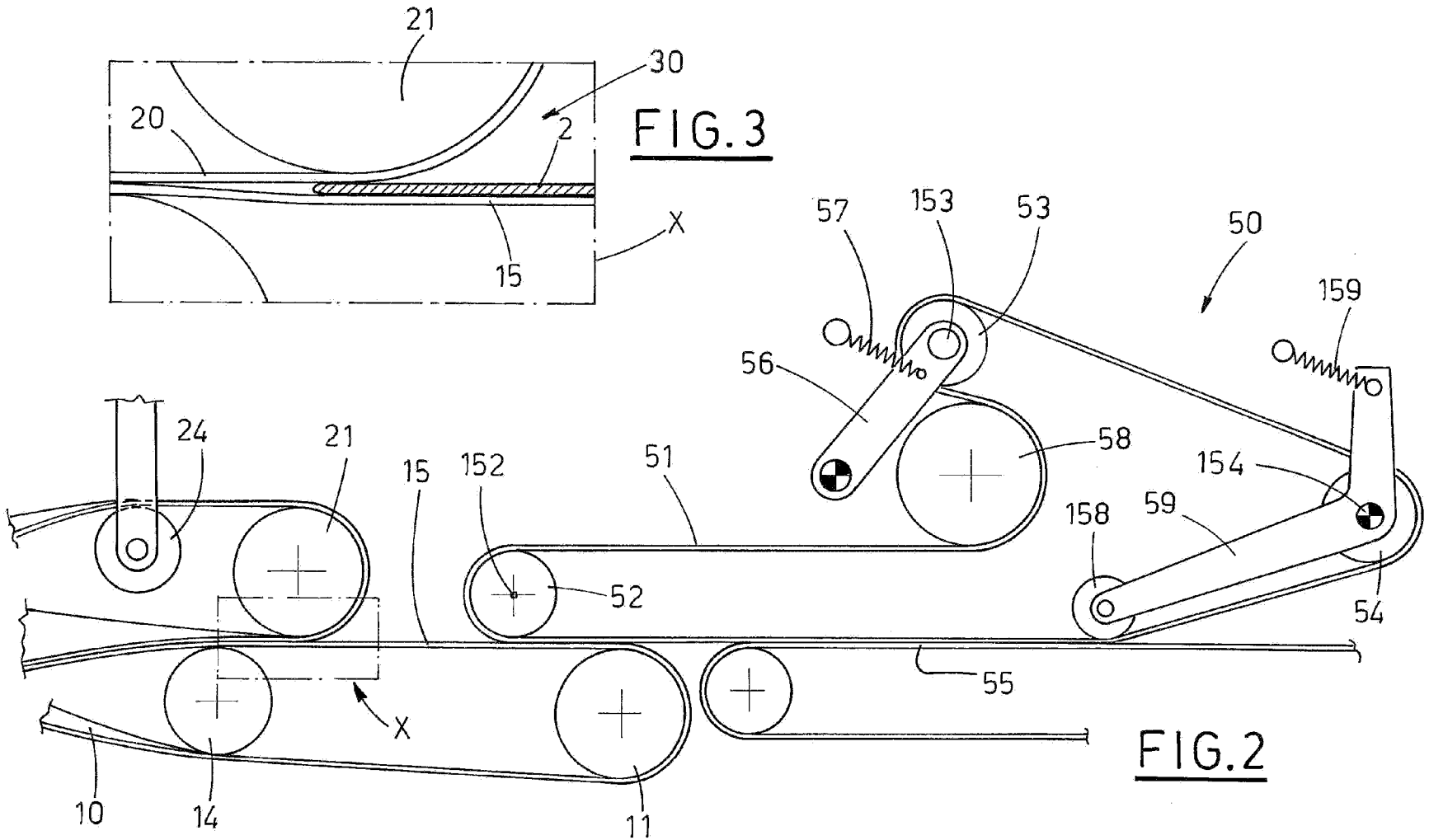
FIG. 2 shows an enlarged view of detail K1 of FIG. 1.
FIG. 3 shows a still further enlarged view of detail X of FIG. 2.

With reference to FIG. 2, concerning the input section 50 of the conveyor 1, it can be seen that the end part of the preparation line 50 of the sheaves 2 partially overlaps the initial portion 15 of the first belt 10.

In the example shown herein, the end part of the preparation line 50 of the sheaves 2 comprises a plurality of belts 51, three in the illustrated example, which are arranged side by side and are mounted on respective series of rollers or pulleys 52, 53, 54, which are arranged in respective transversal rows.

The rollers or pulleys 52, 53, 54 are supported by respective axes 152, 153, 154 which are horizontal and transversal relative to the preparation line 50 and in particular to the advancement direction W of the sheaves.

Figure 4:
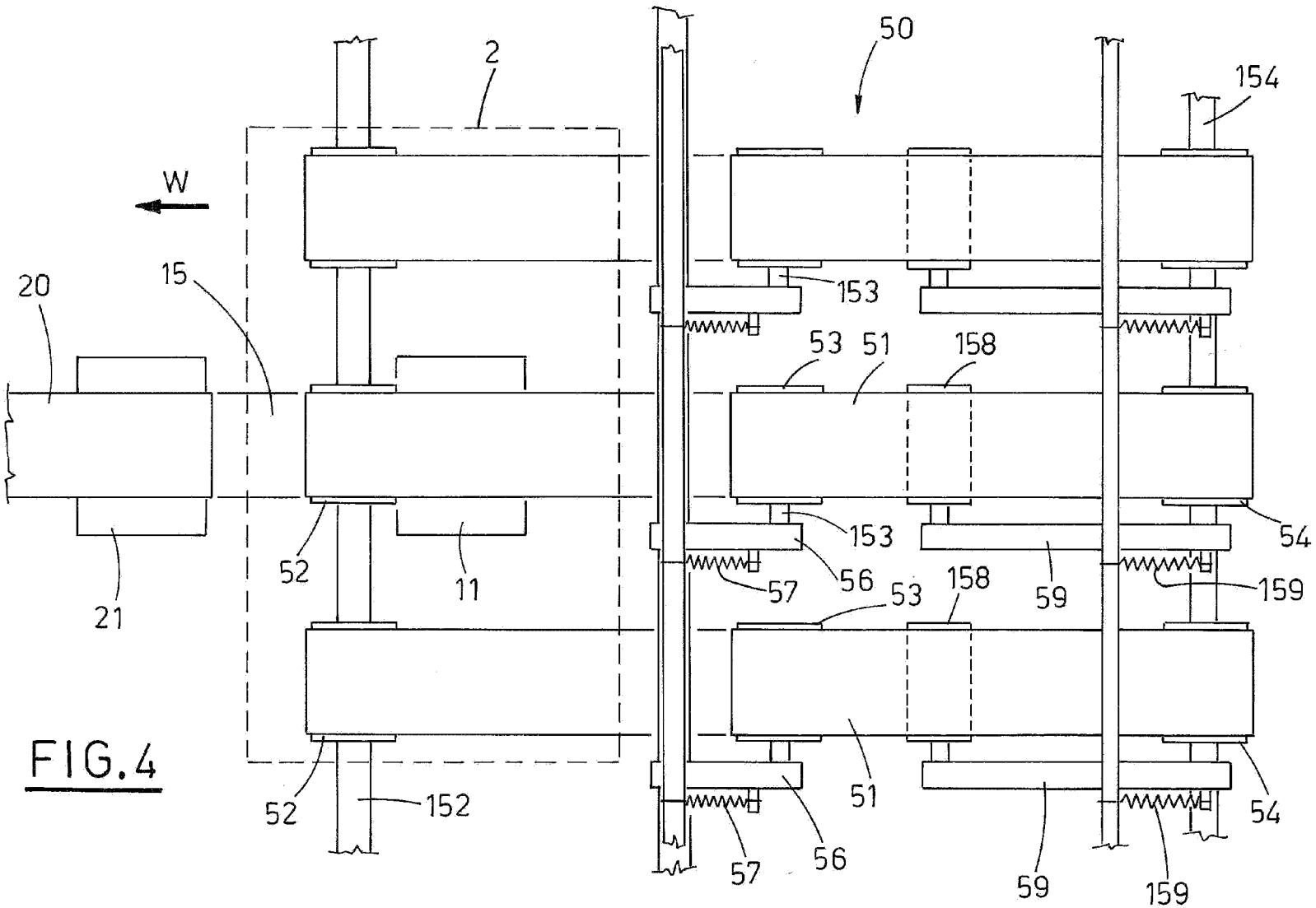
FIG. 4 schematically shows a plan view of the input section of the conveyor.
Figure 5:
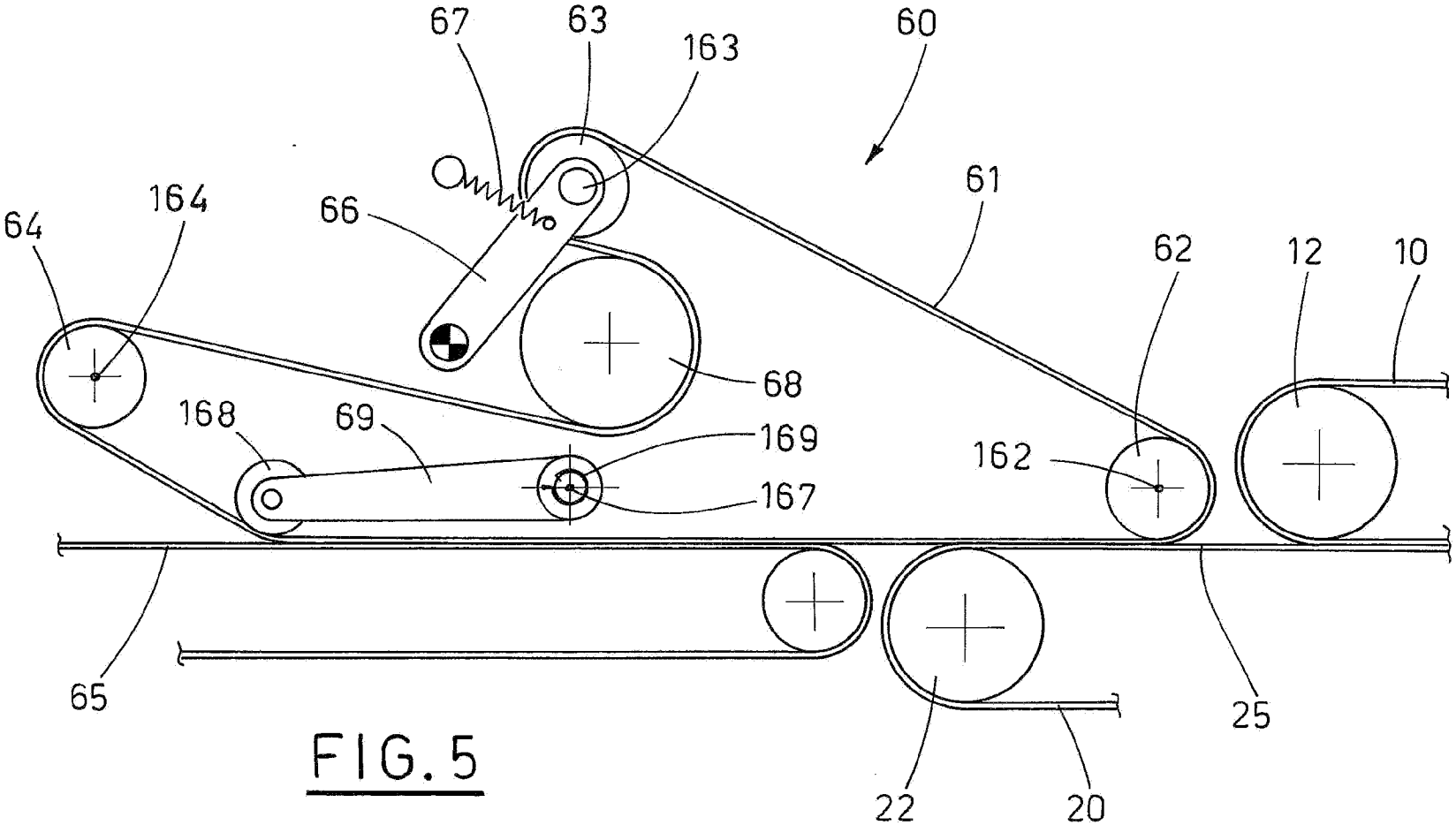
FIG. 5 schematically shows an enlarged view of detail K2 of FIG. 1, relative to the output section of the conveyor.

The axes 152, 154 supporting the rollers or pulleys 52, 54 of the transversal rows which are in a fixed position, are advantageously constituted by a single axis which extends across the entire width of the preparation line 50 (FIG. 4).

One of the rollers or pulleys 53 of each series of rollers or pulleys is mounted on an oscillating arm 56, the axis 153 thereof being constrained to the oscillating arm.

Each oscillating arm 56 is subject to an elastic traction of a spring 57, which is anchored to a fixed point of the structure of the envelope-filling machine. The springs 57, in cooperation with snub rollers or snub pulleys 58, keep the respective belts 51 tensioned.

At least one of the belts 51 is arranged to partially overlap the initial portion 15 of the first belt 10. The remaining part of the belt 51 and the corresponding parts of the other two belts are superposed on an infeed conveyor 55, also a belt, and is situated below the belts 51.

Further, a rocker arm 59 is provided for each belt 51 of the plurality of belts, one end of which rocker arm 59 exhibits a pressure roller 158, which is pressed on an internal part of the relative belt 51 and on the infeed conveyor 55.

Pressure of the roller 158 on the belt 51 and on the infeed conveyor 55 is obtained by virtue of the elastic traction of a spring 159, which acts upon the opposite, free end of the rocker arm 59.

This pressure improves the gripping action on the sheaves between the belts of the conveyor 55 and the belts 51, thus exerting sufficient thrust upon the sheaves to ensure that they are inserted into the conveyor 1, between the upstream roller 11 of the first belt 10 and the corresponding overlying belt 51, which insertion is permitted by a flexion of the belt 51.

In the same way, the pressure of the roller or of the pulley 52 on the underlying initial portion 15 of the first belt 10 ensures the sheaves 2 are inserted between the upstream roller 21 of the second belt 20 and the initial portion 15 of the first belt 10, which insertion is possible because of the flexion of the first belt 10.

In a similar way, but in a practically mirror-image configuration, the access section to the envelope-filling station 60 of the sheaves 2 partially overlaps the end portion 25 of the second belt 20.

The access section to the station 60 for filling envelopes with sheaves 2 also comprises a plurality of belts 61, three in the example shown. The belts 61 are arranged side by side and fitted on respective series of rollers or pulleys 62, 63, 64, which are arranged in transversal rows, which in turn are supported rotatingly by respective horizontal axes 162, 163, 164 which are transversal relative to the extension of the access section 60, and in particular to the advancement direction W.

The axes 162, 164 supporting the rows of rollers or pulleys 62, 64 situated at fixed points, can advantageously be constituted by single axes which extend transversally across the entire width of the access section 60.

At least one of the belts 61 is arranged partially overlapping the end portion 25 of the second belt 20 and all the belts 61 partially overlap an access conveyor 65, also a belt conveyor, situated below the belts 61.

One of each series of rollers or pulleys 63 is mounted with the axis 163 thereof located on a first oscillating arm 66.

Each first oscillating arm 66 is subject to the elastic traction of a spring 67, which is anchored to a fixed point on the structure of the envelope-filling machine.

Each roller or pulley 63, by effect of the traction of the spring on the relative arm 66 and in cooperation with a snub roller or pulley 68, keeps the respective belt 61 tensioned.

Further, for each belt 61 of the plurality of belts, a second oscillating arm 69 is provided, having an end fitted with a pressure roller 168 which is pressed against the internal part of the relative belt 61 and on an access belt conveyor 65.

The action of pressure is obtained in this case by means of the elastic force of a spring 169, for example a pin or a torsion spring, acting upon the support axis of the opposite end of the second oscillating arm 69.

There follows a description of how the conveyor of the invention operates.

Each sheaf is formed by piling sheets of paper or other printed materials one on top of the other, the side bearing the address for example being oriented downwards, and it reaches the conveyor borne by the end section 60 of the preparation line.

Pressed between the upper belts 51 and the lower belts 55, the sheaf is pushed onto the first belt 10, on the upstream roller 11. The upper belt 51 flexes and forms an upwards arc, thus permitting insertion of the sheaf.

Then the sheaf is pushed under the series of rollers or pulleys 52 with the first belt 10 flexing and forming an arc downwards. The sheaf, pressed between the rollers of pulleys 52 and the first belt 10, is subsequently pushed so as to be inserted between the upstream roller 21 of the second belt 20 and the first belt 10, with the first belt flexing downwards.

This stage is shown in detail in FIG. 3, which represents the box X referred to FIG. 2.

At this point, the sheaf 2 which has been collected from the conveyor 1 is transported and at the same time overturned, following the helical trajectory of the two belts 10 and 20.

Helical guides, which are not shown, accompany the free edges of the sheaf preventing unwanted creases in the sheets of paper or printed materials during the displacement.

Downstream of the output section 40, the overturned sheaves are delivered to the access section 60 of the envelope-filling station, following steps which are similar to those implemented upstream of the input section 30.

It is clear that the aims described in the preamble have all been achieved with the described device, thus making it possible to obtain the consequent advantages both constructionally and functionally.

The vertically mobile elements for supporting the rollers in the input and output sections have been eliminated. Compensation for variations in the thickness of the sheaves, across a wide but obviously defined interval, is obtained thanks to the flexing of the belt which is counter-positioned to the roller involved, at the different stages.

In addition to reducing constructional complexity, and therefore reducing the cost of producing the machine, the envelope-filling machine, which is provided with the conveyor forming the object of this invention, requires less maintenance, and fewer adjustment interventions.

Torsion of the first and second belts makes it possible to overturn the sheaf without having to halt the machine and/or to insert the sheaf into a frame which can be rotated about itself, in one direction or the other.

The advantage is that not only is a greater operating speed obtained, but also the risks of jamming are reduced, thanks to a simpler configuration and fewer passages of the sheaves from one component to another.

A positive effect on the costs of building the machine is also obtained thanks to this constructionally simpler configuration of the conveyor.

The above has been described by way of non-limiting example, so that any variants and special embodiments of the invention are understood to be comprised within the ambit of protection sought for the invention as set out in the following claims.

The invention claimed is:

1. A conveyor for conveying and overturning flat objects, such as piled-up sheaves of paper or printed materials, comprising:

a first ring-wound belt (10) mounted on rollers, respectively an upstream roller (11) of the first belt (10) and a downstream roller (12) of the first belt (10), a second ring-wound belt (20) mounted on rollers, respectively an upstream roller (21) of the second belt (20) and a downstream roller (22) of the second belt (20), with an active branch (13) of the first belt (10) facing and in contact with a corresponding active branch (23) of the second belt (20), thus constituting an input section (30) between the upstream roller (11) of the first belt (10) and the upstream roller (21) of the second belt (20), and an output section (40) between the downstream roller (12) of the first belt (10) and the downstream roller (22) of the second belt (20), the first belt (10) and the second belt (20) being subjected to an axial torsion of 180°, in order to exchange the position of the first belt (10) and the second belt (20);

the first belt (10) longitudinally staggered in relation to the second belt (20), so that the upstream roller (11) of the first belt (10) is staggered in relation to the corresponding upstream roller (21) of the second belt (20), and the downstream roller (22) of the second belt (20) is staggered in relation to the downstream roller (12) of the first belt (10);

a support roller (14) contacting and horizontally supporting the first belt, which support roller (14) is arranged downstream of the upstream roller (21) of the second belt (20), defining a zone therebetween where the first belt and the second belt overlap, the support roller (14) maintaining the first belt (10) and the second belt (20) in a horizontal position from the input section (30) through the zone.

2. The conveyor of claim 1, wherein the active branch (13) of the first belt (10) is situated in a lower position at the input section (30) and is situated into a higher position at the output section (40), and contrarily, the active branch (23) of the second belt (20) is situated in the upper position at the input section (30) and is situated into the lower position at the output section (40).

3. The conveyor of claim 1 wherein the first belt (10) is staggered relative to the second belt (20) such that an initial portion (15) of the first belt (10) projects in relation to the second belt (20) towards an end portion of a preparation line (50).

4. The conveyor of claim 1 wherein the first belt (10) is staggered relative to the second belt (20) such that an end portion (25) of the second belt 20 projects in relation to the first belt (10) towards an access section of an envelope-filling station (60).

5. The conveyor of claim 1 further comprising a support roller (24) provided for the second belt (20), which support roller (24) is located downstream of the upstream roller (21) of the second belt (20), for supporting an inactive branch of the second belt (20).

6. The conveyor of claim 3 further comprising a preparation line (50) of the sheaves (2) having an end part which partially overlaps the initial portion (15) of the first belt (10).

7. The conveyor of claim 6, further comprising an end part of a sheave preparation line formed by a plurality of belts (51) which are arranged side by side and fitted on respective series of rollers or pulleys (52, 53, 54), at least one belt partially overlapping the initial portion (15) of the first belt (10) and wherein the plurality of belts partially overlap an infeed belt conveyor (55), situated below the plurality of belts (51).

8. The conveyor of claim 7, wherein the rollers or pulleys (52, 53, 54) are supported by respective axes (152, 153, 154) which are horizontal and transversal in relation to the preparation line (50) and to an advancement direction (W).

9. The conveyor of claim 8, wherein the axes (152, 154) which support rollers or pulleys (52, 54) in a fixed position are constituted each by a single axis which crosses an entire width of the preparation line (50).

10. The conveyor of claim 7 wherein one of the rollers or pulleys (53) of each series of rollers or pulleys is mounted on an oscillating arm (56) which is subject to elastic traction of a spring (57) which, in cooperation with a roller or snub pulley (58), keeps the respective belt (51) tensioned.

11. The conveyor of claim 7 further comprising, for each belt (51) of the plurality of belts, a rocker arm (59) having an end provided with a pressure roller (158) pressed on an internal part of the relative belt (51) and on the infeed belt conveyor (55), by virtue of an elastic traction of a spring (159) acting upon an opposite end of the rocker arm (59).

12. The conveyor of claim 1 further comprising a station (60) for filling envelopes having an access section which partially overlaps an end portion (25) of the second belt (20).

13. The conveyor of claim 12, wherein the access section of the station (60) for filling envelopes comprises a plurality of belts (61) which are arranged side by side and mounted on respective series of rollers or pulleys (62, 63, 64), at least one belt of the plurality of belts partially overlaps the end portion (25) of the second belt (20) and the plurality of belts (61) are partially situated above, and in contact with an infeed belt conveyor (65).

14. The conveyor of claim 13, wherein the rollers or pulleys (62, 63, 64) are supported by respective axes (162, 163, 164) which are horizontal and transversal in relation to the access section (60) and in particular to the advancement direction (W).

15. The conveyor of claim 14, wherein the axes (162, 164) which support the rollers or pulleys (62, 64) in a fixed position are each constituted by a single axis which crosses an entire width of the access section (60).

16. The conveyor of claim 15, wherein one of the rollers or pulleys (63) of each series of rollers or pulleys is fitted on a first oscillating arm (66) which is subject to an elastic traction of a spring (67) which, in cooperation with a snub roller or a pulley (68) keeps the respective belt (61) tensioned.

17. The conveyor of claim 16, wherein for each belt (61) of the plurality of belts, a second oscillating arm (69) is provided having an end which is provided with a pressure roller (168) pressed on an internal part of the relative belt (61) and on the infeed belt conveyor (65), by virtue of an elastic force of a spring (169) acting on an opposite end of the second oscillating arm (69).

18. The conveyor of claim 15, wherein for each belt (61) of the plurality of belts, a second oscillating arm (69) is provided having an end which is provided with a pressure roller (168) pressed on an internal part of the relative belt (61) and on the infeed belt conveyor (65), by virtue of an elastic force of a spring (169) acting on an opposite end of the second oscillating arm (69).

* * * * *